US008547184B2

(12) United States Patent
Washiro

(10) Patent No.: US 8,547,184 B2
(45) Date of Patent: Oct. 1, 2013

(54) HIGH-FREQUENCY COUPLER AND COMMUNICATION DEVICE

(75) Inventor: Takanori Washiro, Kanagawa (JP)

(73) Assignee: Sony Corporation, Tokyo (JP)

( * ) Notice: Subject to any disclaimer, the term of this patent is extended or adjusted under 35 U.S.C. 154(b) by 405 days.

(21) Appl. No.: 13/039,863

(22) Filed: Mar. 3, 2011

(65) Prior Publication Data

US 2011/0222586 A1 Sep. 15, 2011

(30) Foreign Application Priority Data

Mar. 12, 2010 (JP) ..... 2010-056561

(51) Int. Cl.
*H01P 5/04* (2006.01)
*H01Q 9/26* (2006.01)

(52) U.S. Cl.
USPC ..... 333/24 R; 333/220; 343/803

(58) Field of Classification Search
USPC ..... 333/24 R, 24 C, 219, 220, 245, 246; 343/793, 794, 795, 803, 816
See application file for complete search history.

(56) References Cited

U.S. PATENT DOCUMENTS 7,605,764 B2 * 10/2009 Ishimiya ..... 343/702
7,750,851 B2 7/2010 Washiro
8,198,960 B2 * 6/2012 Washiro ..... 333/204
8,289,100 B2 * 10/2012 Washiro ..... 333/24 R
8,299,868 B2 * 10/2012 Kato et al. ..... 333/24 R
8,334,728 B2 * 12/2012 Washiro ..... 333/24 R
8,339,213 B2 * 12/2012 Washiro ..... 333/24 R
2008/0117117 A1 5/2008 Washiro
2011/0222585 A1 9/2011 Washiro
2011/0228814 A1 9/2011 Washiro
2011/0230136 A1 9/2011 Washiro

FOREIGN PATENT DOCUMENTS

JP 4345849 7/2009

OTHER PUBLICATIONS www.transferjet.org/index.html, 2009 Copyright Transfer Jet Consortium.

* cited by examiner

*Primary Examiner* — Dean O Takaoka
(74) *Attorney, Agent, or Firm* — Wolf, Greenfield & Sacks, P.C.

(57) ABSTRACT

A high-frequency coupler includes a ground, a coupling electrode which faces the ground and is supported so as to be separated by a negligible height with respect to a high-frequency signal, a resonating unit for increasing a current flowing into the coupling electrode, a supporting unit which is connected to the resonating unit, and a short-circuiting unit which short-circuits the tip portions of the coupling electrode, in which an infinitesimal dipole constituted by a line connecting the center of the charges accumulated in the coupling electrode and the center of mirror-image charges accumulated in the ground is formed, and the high-frequency signal is transmitted toward a high-frequency coupler of a communication partner so that the angle θ formed in the direction of the infinitesimal dipole is substantially 0 degrees.

4 Claims, 12 Drawing Sheets

HIGH-FREQUENCY COUPLER AND COMMUNICATION DEVICE

BACKGROUND OF THE INVENTION

1. Field of the Invention

The present invention relates to a high-frequency coupler and a communication device that perform large-volume data transmission in proximity through a weak UWB (Ultra Wide Band) communication method using a high-frequency wide-band, and particularly to a high-frequency coupler and a communication device that secure a communication range in the transverse direction in weak UWB communication using electric field coupling.

2. Description of the Related Art

Non-contact communication has been widely used as a medium for authentication information, electronic money, or other value information. In addition, in recent years, as additional applications of such a non-contact communication system, large-capacity data transmission such as downloading and streaming of moving images, music, or the like can be exemplified. Such large-volume data transmission can also be implemented by the operations of a single user, preferably completed within the same access time as used by the existing authentication or billing process, and therefore it is necessary to increase the communication rate.

The general RFID standard uses the 13.56 MHz band, is for proximity type (0 to 10 cm or shorter: Proximity) non-contact bidirectional communication adopting the main principle of electromagnetic induction, and employs a communication rate of about 106 kbps to 424 kbps. On the other hand, TransferJet (for example, refer to Japanese Patent No. 4345849 and www.transferjet.org/en/index.html) that uses weak UWB signals can be exemplified as a proximity wireless transfer technology applicable to high-speed communication. The proximity wireless transfer technology (TransferJet) is basically a method for transmitting signals by using the action of electric field coupling, and a high-frequency coupler of such a communication device includes a communication circuit unit that processes high-frequency signals, a coupling electrode that is arranged in a certain height apart from the ground, and a resonating unit that supplies high-frequency signals to the coupling electrode efficiently.

The proximity wireless transfer using the weak UWB has a communication distance of about 2 to 3 cm, only about as wide both in the longitudinal and transverse directions, is without polarized waves, and has a communication range in the shape of a substantially hemisphere dome. For that reason, it is necessary to activate electric field coupling effectively by facing the coupling electrodes appropriately to each other between communication devices for performing data transmission.

If a functioning unit of proximity wireless transfer is manufactured in a small size, the function will be suitable for incorporation, and can be mounted in various kinds of information equipment, for example, personal computers, mobile phones, or the like. However, if the size of a coupling electrode in a high-frequency coupler is reduced, there is a problem that the communication range diminishes particularly in the transverse direction. For example, if a target point, which indicates a spot where a high-frequency coupler is embedded, is marked on the housing surface of information equipment, a user may conduct an alignment aimed toward the target point. However, if the communication range of the transverse direction is narrow, a target point may be obscured by the shadow of the other equipment when they are adjacent, resulting that the target point is aligned while shifted from the center thereof in the transverse direction.

In order to improve usability in practical use of the proximity wireless transfer function, it is necessary to extend the communication range in the transverse direction. However, if the size of a coupling electrode in a high-frequency coupler is simply increased, a standing wave occurs on the surface of a coupling electrode. Then, since charges with different polarities are distributed and electric fields of both of the adjacent electric fields with the different polarities are cancelled at a portion where the amplitude of the standing wave travels in opposite directions, places having the electric field with high intensity and low intensity appear. The place having the electric field with low intensity becomes a dead-point (null point) in which fine effect of electric field coupling is not easily obtained, even when the coupling electrode of a communication partner is aligned.

A high-frequency coupler basically radiates electric field signals only in the front direction and does not radiate signals in the side direction. For this reason, unless the front faces of communication devices incorporated with high-frequency couplers face each other, stable communication is not secured, and therefore, usability is unsatisfactory.

SUMMARY OF THE INVENTION

It is desirable for the present invention to provide an excellent high-frequency coupler and a communication device that enable the large-volume data transmission in proximity in a weak UWV communication method using a high-frequency wide-band.

It is further desirable for the invention to provide an excellent high-frequency coupler and a communication device that can secure a sufficient communication range in the transverse direction in proximity wireless transfer using the weak UWB without polarized waves.

According to an embodiment of the present invention, there is provided a high-frequency coupler including a ground, a coupling electrode which faces the ground and is supported so as to be separated by a negligible height with respect to the wavelength of a high-frequency signal, a resonating unit for increasing a current flowing into the coupling electrode via a transmission path, a supporting unit which is connected to the resonating unit at about the center of the coupling electrode, and a short-circuiting unit which short-circuits the tip portions of the coupling electrode to the ground, in which an infinitesimal dipole constituted by a line connecting the center of the charges accumulated in the coupling electrode and the center of mirror-image charges accumulated in the ground is formed, and the high-frequency signal is transmitted toward a high-frequency coupler of a communication partner side arranged to face each other so that the angle θ formed in the direction of the infinitesimal dipole is substantially 0 degrees.

According to the embodiment of the present invention, the coupling electrode in the high-frequency coupler has a size of ½ of the wavelength from the root of the supporting unit to the tip portions which are short-circuited to the ground via the short-circuiting unit.

According to the embodiment of the present invention, the front direction of the coupling electrode is the radiation direction of electric field signals in which the face can serve as a first radiating face, and the side direction of the short-circuiting unit is a radiation direction of electric field signals in which the face can serve as a second radiating face.

According to an embodiment of the present invention, there is provided a communication device including a communication circuit unit which performs a process of a high-frequency signal transmitting data, a transmission path of a high-frequency signal connected to the communication circuit unit, a coupling electrode which faces the ground and is supported so as to be separated by a negligible height with respect to the wavelength of the high-frequency signal, a resonating unit for increasing a current flowing into the coupling electrode via the transmission path, a supporting unit which is connected to the resonating unit at about the center of the coupling electrode, and a short-circuiting unit which short-circuits the tip portions of the coupling electrode to the ground, in which the coupling electrode has a size of ½ of the wavelength from the root of the supporting unit to the tip portions which are short-circuited to the ground via the short-circuiting unit, and an infinitesimal dipole constituted by a line connecting the center of the charges accumulated in the coupling electrode and the center of mirror-image charges accumulated in the ground is formed, and the high-frequency signal is transmitted toward a high-frequency coupler of a communication partner side arranged to face each other so that the angle θ formed in the direction of the infinitesimal dipole is substantially 0 degrees.

According to an embodiment of the invention, there is provided an excellent high-frequency coupler and a communication device that enable large-volume data transmission in proximity by a weak UWB communication method using a high-frequency wide-band.

According to an embodiment of the invention, there is provided an excellent high-frequency coupler and a communication device that can secure a sufficient communication range in the transverse direction in proximity wireless transfer using the weak UWB without polarized waves.

According to an embodiment of the invention, there is provided an excellent high-frequency coupler and a communication device that can expand the communication range particularly in the transverse direction by increasing the size of a coupling electrode and radiating an electric field signal in a wide range.

According to an embodiment of the invention, since the communication range can be expanded in the transverse direction mainly from the center of the coupling electrode, users can conduct stable communication even without having to bring the marks of the target points into close proximity for alignment when, for example, the information equipment incorporated with high-frequency couplers are made to face each other.

Other goal, characteristics, advantages of the present invention will be clarified by detailed descriptions based on embodiments of the present invention to be described later and accompanying drawings.

DESCRIPTION OF THE PREFERRED EMBODIMENTS

Hereinbelow, an embodiment of the present invention will be described in detail with reference to drawings.

Figure 1:
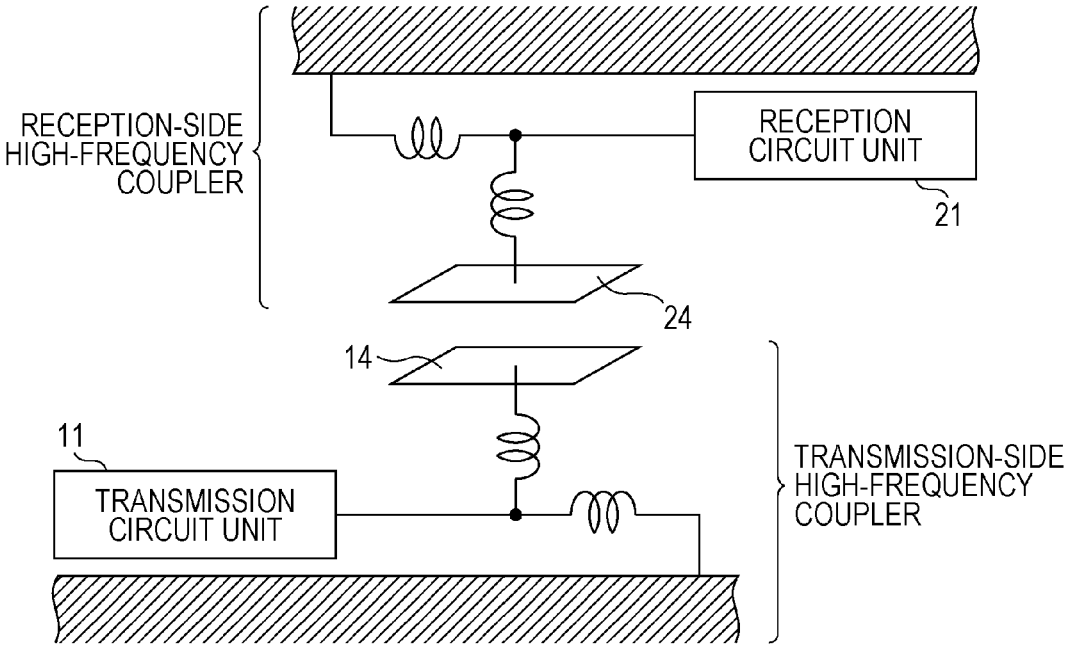
FIG. 1 is a diagram schematically illustrating the configuration of a proximity wireless transfer system by a weak UWB communication method.

FIG. 1 is a diagram schematically illustrating the composition of a proximity wireless transfer system in the weak UWB communication method using the action of electric field coupling. In the same drawing, coupling electrodes 14 and 24 used in transmission and reception that belong to a transmitter 10 and a receiver 20 respectively are arranged apart, for example, by about 3 cm (or about ½ of the wavelength of the frequency band being used) from each other in an opposed manner so as to enable electric field coupling. The transmission circuit unit 11 in the transmitter side generates high-frequency transmission signals such as UWB signals based on transmission data when a transmission request is made from an higher level application, and the signals penetrate from the transmitting electrode 14 to the receiving electrode 24 as electric field signals. In addition, the reception circuit unit 21 in the receiver 20 side performs the processes of demodulation and decoding for the received high-frequency electric field signals and passes the produced data to the higher level application.

If the UWB is used in the proximity wireless transfer, ultra-high-speed data transfer of 100 Mbps can be realized. In addition, in the proximity wireless transfer, the coupling action of an electrostatic field or an induced electric field is used as described later, not a radiated electric field. Since the intensity of an electric field is in proportion to the cube or the square of a distance, a proximity wireless transfer system can be used as weak wireless unnecessary with license from a radio station by suppressing the intensity of the electric field to a certain level or lower within a distance of 3 meters from the wireless facility and formed at a low cost. In addition, since data communication is performed in the electric field coupling method in the proximity wireless transfer, it is advantageous in that interference influences only slightly as reflected waves from reflective objects in the peripheral environment are small, and that consideration of preventing hacking or securing confidentiality on the transmission path is not necessary.

On the other hand, in wireless communication, the propagation loss gets greater according to the extent of the distance that the wavelength propagates. In the proximity wireless transfer that uses high-frequency wide-band signals as the UWB signals, the communication distance of about 3 cm is equivalent to ½ of the wavelength. In other words, the communication distance can be said to be proximal but is a length that is not negligible, and therefore, the propagation loss is necessary to be suppressed to a sufficiently low level. Above all, a high-frequency circuit has a more serious problem in characteristic impedance in comparison to a low-frequency circuit, and has significant influence caused by impedance mismatch in the coupling point between the electrodes of the transmitter and the receiver.

For example, in the proximity wireless transfer system shown in FIG. 1, even if the transmission path of high-frequency electric field signals connecting the transmission circuit unit 11 and the transmitting electrode 14 is on a coaxial line where 50Ω of impedance is matched, the electric field signals are reflected causing propagation losses when the impedance in the coupling portion between the transmitting electrode 14 and the receiving electrode 24 is mismatched, thereby lowering communication efficiency.

Figure 2:
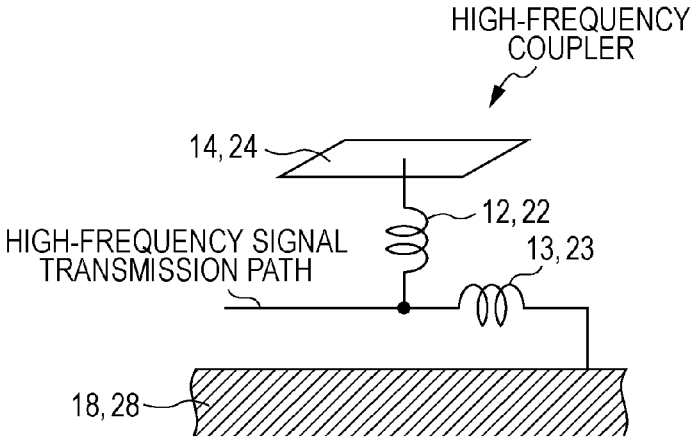
FIG. 2 is a diagram illustrating the basic composition of a high-frequency coupler where a transmitter and a receiver are arranged.

Accordingly, as shown in FIG. 2, the high-frequency coupler arranged in each of the transmitter 10 and the receiver 20 is configured such that plate-shaped electrodes 14 and 24 and a resonating unit that includes series inductors 12 and 22 and parallel inductors 13 and 23 are connected to a high-frequency signal transmission path. The high-frequency signal transmission path referred here can be constituted by a coaxial cable, a micro-strip line, a coplanar line or the like. If high-frequency couplers of such a kind are arranged to face each other, a coupling portion acts as a band-pass filter in extreme proximity where a quasi-electric field is dominant, thereby high-frequency signals can be transferred. In addition, even in a distance that is not negligible with respect to a wavelength and an induced electric field is dominant, the high-frequency signals can be transferred efficiently between two high-frequency couplers via an induced electric field generated from an infinitesimal dipole (described later) formed by charges and mirror-image charges respectively accumulated in the coupling electrode and the ground.

Hence, if it is aimed to simply match impedance and only suppress reflected waves between the electrodes of the transmitter 10 and the receiver 20, that is, in the coupling portion, the impedance in the coupling portion can be designed to be continuous even when each coupler employs a simple configuration where the plate-shaped electrodes 14 and 24 and the series inductors 12 and 22 are in series connection on the high-frequency signal transmission path. However, since characteristic impedance in the front and rear parts of the coupling portion does not change, the current amplitude does not change. With respect to the point, bigger charges can be sent to the coupling electrode 14 by providing the parallel inductors 13 and 23, and strong electric field coupling action can occur between the coupling electrodes 14 and 24. In addition, a large electric field is induced around the surface of the coupling electrode 14, and the generated electric field propagates from the surface of the coupling electrode 14 to the front direction (the direction of the infinitesimal dipole to be described later) as an electric field signal of an oscillating longitudinal waves. The waves of the electric field enable the electric field signal to propagate even when the distance between the coupling electrodes 14 and 24 (phase height) is relatively long.

To summarize, vital conditions of a high-frequency coupler in a proximity wireless transfer system by a weak UWB communication method are as follows.

(1) To provide a coupling electrode facing the ground in order to perform coupling with an electric field at a location separated from the wavelength of a high-frequency signal by a negligible height (2) To provide a resonating unit in order to perform coupling with a stronger electric field (3) To set a constant of a capacitor by series/parallel inductors and a coupling electrode or the height of a stub so as to take impedance matching when coupling electrodes are placed to face each other in a frequency band used for communication.

When the coupling electrodes 14 and 24 of the transmitter 10 and the receiver 20 are faced with an appropriate distance apart from each other in the proximity wireless transfer system shown in FIG. 1, two high-frequency couplers operate as a band-pass filter through which electric field signals pass in a predetermined high-frequency band, and a single high-frequency coupler acts as an impedance converting circuit that amplifies currents, thereby flowing currents with high amplitude in the coupling electrodes. On the other hand, when the high-frequency coupler is independently placed in a free space, the input impedance of the high-frequency coupler does not correspond to a characteristic impedance on the high-frequency signal transmission path, the signal that enters into the high-frequency signal transmission path is reflected in the high-frequency coupler, but not emitted to the outside, and therefore, the signal does not give influence on other neighboring communication systems. In other words, when there is no communication partner, the transmitter does not release radio waves as antennas of the past did, and high-frequency electric field signals are transferred by taking impedance matching only when the communication partner gets closer.

Figure 3:
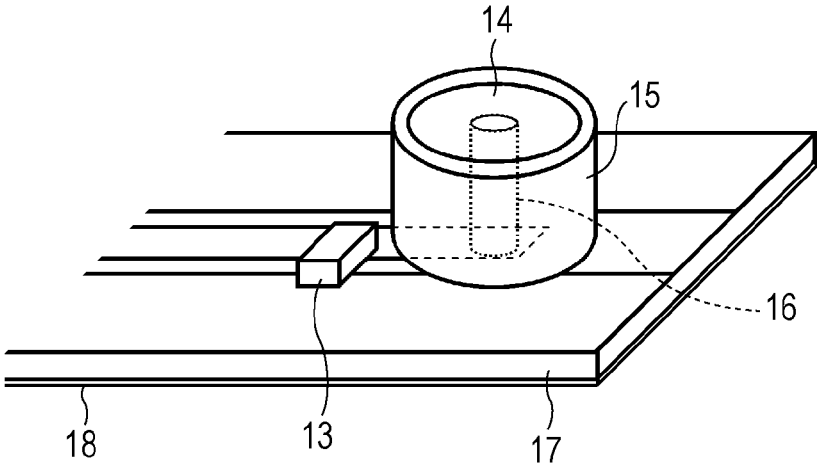
FIG. 3 is a diagram illustrating an embodiment of the high-frequency coupler shown in FIG. 2.

FIG. 3 shows an embodiment of the high-frequency coupler shown in FIG. 2. Both of the high-frequency couplers of the transmitter 10 and the receiver 20 can be configured in the same manner. In the drawing, the coupling electrode 14 is provided on the top surface of a spacer 15 made of a dielectric, and electrically connected to the high-frequency signal transmission path on the printed board 17 via a through-hole 16 penetrating the spacer 15. In the same drawing, the spacer 15 has a substantially cylindrical shape, and the coupling electrode 14 has a substantially circular shape, but neither of them is limited to a specific shape.

For example, after a dielectric having a desired height is formed with the through-hole 16 therein, the through-hole 16 is filled with a conductor, and a conductor pattern to be the coupling electrode 14 is deposited on the top surface of the dielectric using, for example, by a plating technique. In addition, a wiring pattern serving as the high-frequency signal transmission path is formed on the printed board 17. Then, the high-frequency coupler can be made by mounting the spacer 15 on the printed board 17 by conducting reflow soldering. The appropriate adjustment of the height from the circuit-mounted surface on the printed board 17 (or the ground 18) to the coupling electrode 14, that is, the length of the through-hole 16 (phase height) in accordance with a wavelength to be used makes it possible for the through-hole 16 to have inductance and to be substituted for the series inductor 12 shown in FIG. 2. In addition, the high-frequency signal transmission path is connected to the ground 18 via the chip-shaped parallel inductor 13.

Herein, the electromagnetic field generated in the coupling electrode 14 in the side of the transmitter 10 will be discussed.

As shown in FIGS. 1 and 2, the coupling electrode 14 is connected to one end of the high-frequency signal transmission path, and accumulates charges with high-frequency signals that are output from the transmission circuit unit 11 and flow therein. At this moment, the charges flowing into the coupling electrode 14 via the transmission path are amplified by a resonating effect of the resonating unit formed of the series inductor 12 and the parallel inductor 13, and larger charges are accumulated.

In addition, the ground 18 is provided separated from the wavelength of the high-frequency signal by a negligible height (phase height) so as to face the coupling electrode 14. Then, if charges are accumulated in the coupling electrode 14 as described above, mirror-image charges are accumulated in the ground 18. If point charges Q are placed outside the planar conductor, mirror-image charges −Q (which is virtual and replaces the surface charge distribution) are provided in the planar conductor, but this matter is the related art as described in, for example, "Electromagnetics" written by Tadashi Mizoguchi (pp. 54 to 57, Shokabo).

As a result of the point charges Q and the mirror-image charges −Q being accumulated as described above, the infinitesimal dipole formed by a line connecting the center of the charges accumulated in the coupling electrode 14 and the center of the mirror-image charges accumulated in the ground 18 is formed. Strictly speaking, the charges Q and the mirror-image charges −Q have the volume, and the infinitesimal dipole is formed so that the center of the charges and the center of the mirror-image charges are connected to each other. The "infinitesimal dipole" mentioned here refers to "a dipole that has a very short distance between charges of an electric dipole". For example, "Antennas and Propagation" written by Yasuto Mushiake (pp. 16 to 18, Corona) also describes the "infinitesimal dipole". In addition, the infinitesimal dipole causes to generate a transverse wave component $E_\theta$ of the electric field, a longitudinal wave component $E_R$ of the electric field, and a magnetic field $H_\phi$ in the circumference of the infinitesimal dipole.

Figure 4:
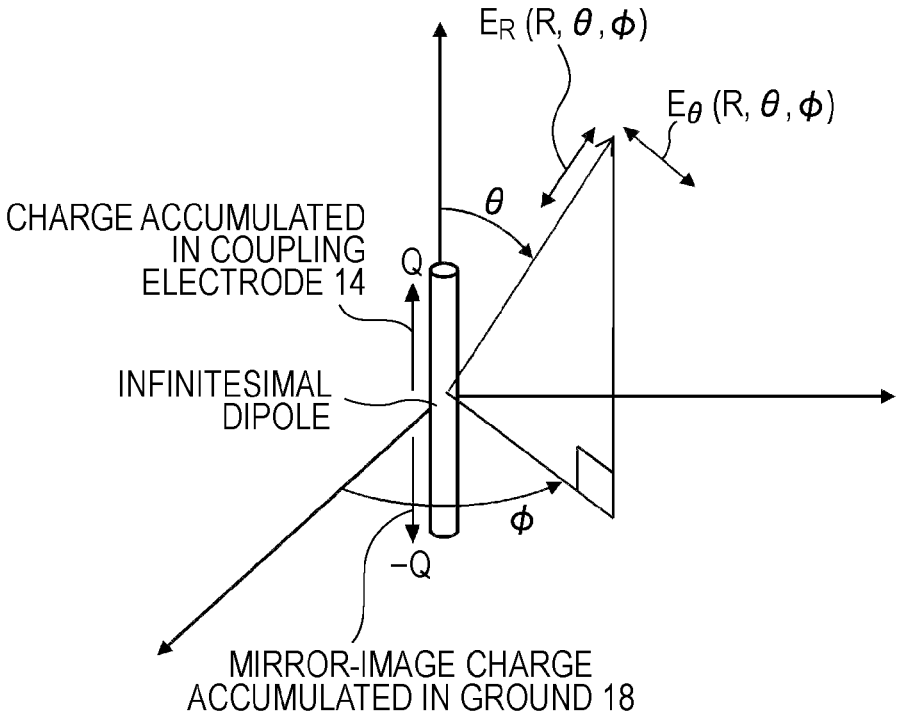
FIG. 4 is a diagram showing an electric field by an infinitesimal dipole.
Figure 5:
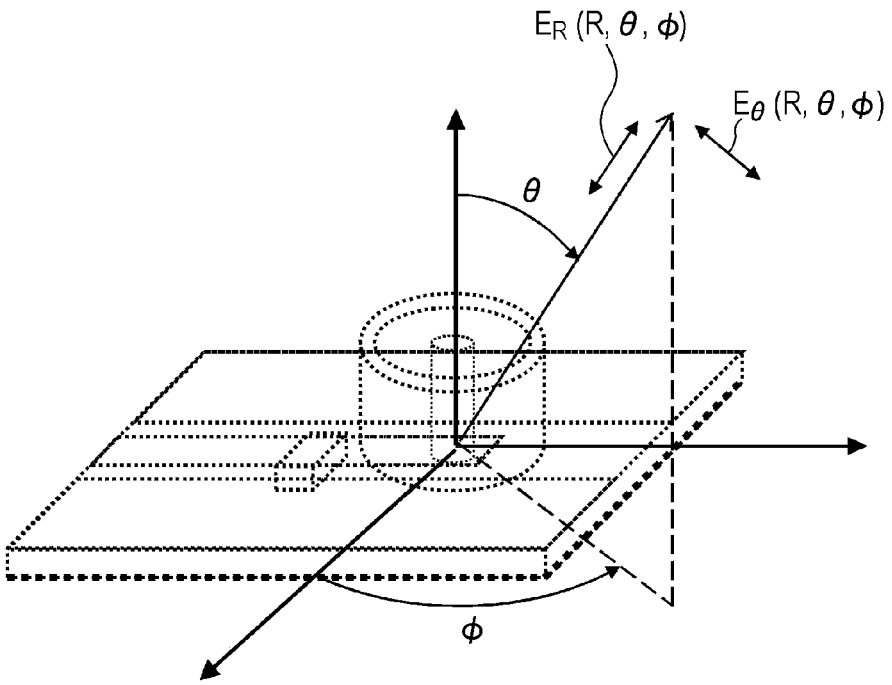
FIG. 5 is a diagram in which the electric field shown in FIG. 4 is matched on a coupling electrode.

FIG. 4 shows the electric field of the infinitesimal dipole. In addition, FIG. 5 illustrates the state where the electric field is matched on the coupling electrode. As shown in the drawings, the transverse wave component $E_\theta$ of the electric field oscillates in a direction perpendicular to the propagating direction, and the longitudinal wave component $E_R$ of the electric field oscillates in parallel with the propagating direction. In addition, the magnetic field $H_\phi$ is generated in the circumference of the infinitesimal dipole. Formulas (1) to (3) below express the electromagnetic field generated by the infinitesimal dipole. In the formulas, the component in inverse proportion to the cube of the distance R is a static electromagnetic field, the component in inverse proportion to the square of the distance R is an induced electromagnetic field, and the component in inverse proportion to the distance R is a radiated electromagnetic field.

$$E_\theta = \frac{pe^{-jkR}}{4\pi\varepsilon}\left(\frac{1}{R^3} + \frac{jk}{R^2} - \frac{k^2}{R}\right)\sin\theta \tag{1}$$

$$E_R = \frac{pe^{-jkR}}{2\pi\varepsilon}\left(\frac{1}{R^3} + \frac{jk}{R^2}\right)\cos\theta \tag{2}$$

$$H_\phi = \frac{j\omega pe^{-jkR}}{4\pi}\left(\frac{1}{R^2} + \frac{jk}{R}\right)\sin\theta \tag{3}$$

In order to suppress interfering waves to peripheral systems, it is preferably considered that the transverse wave $E_\theta$ that includes the component of the radiated electric field is suppressed and the longitudinal wave $E_R$ that does not include the component of the radiated electric field is used in the proximity wireless transfer system shown in FIG. 1. The reason is because the transverse wave component $E_\theta$ of the electric field includes the radiated electric field that is in inverse proportion to a distance (in other words, that shows slight reduction in a distance), but the longitudinal wave component $E_R$ does not include the radiated electric field, as understood from the formulas (1) and (2) above.

Figure 6:
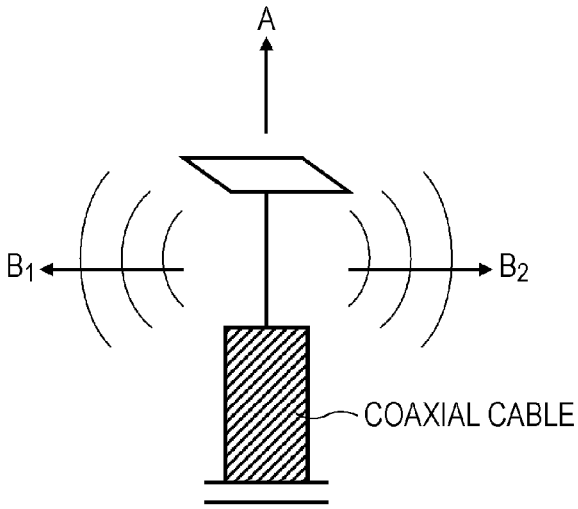
FIG. 6 is a diagram illustrating the composition example of a capacity-loaded type antenna.

First of all, in order not to bring about the transverse wave $E_\theta$ of the electric field, it is necessary for the high-frequency coupler not to operate as an antenna. The high-frequency coupler shown in FIG. 2 has a similar structure to a "capacity-loaded type" antenna that has electrostatic capacity by attaching metal on the tip of an antenna element and of which the height is reduced. Therefore, it is necessary for the high-frequency coupler not to operate as a capacity-loaded type antenna. FIG. 6 shows a composition example of the capacity-loaded type antenna, and the longitudinal wave component $E_R$ of the electric field is generated largely in the direction of Arrow A and the transverse wave $E_\theta$ of the electric field is generated in the directions of Arrows $B_1$ and $B_2$.

In the composition example of the coupling electrode shown in FIG. 3, the dielectric 15 and the through-hole 16 play both roles of avoiding the coupling of the coupling electrode 14 and the ground 18 and of forming the series inductor 12. The electric coupling of the ground 18 and the electrode 14 is avoided and the effect of the electric coupling with the high-frequency coupler of the receiver side is secured by configuring the series inductor 12 with a sufficient height from the circuit mounting surface on the printed board 17 to the electrode 14. However, if the height of the dielectric 15 is high, in other words, if the distance from the circuit mounting surface on the printed board 17 to the electrode 14 has a length that is not able to be negligible for the used wavelength, the high-frequency coupler acts as a capacity-loaded type antenna, and thus the transverse wave $E_\theta$ is generated as indicated by Arrows $B_1$ and $B_2$ in FIG. 6. Therefore, there are conditions that the height of the dielectric 15 is to be a sufficient length for forming the series inductor 12 necessary for acquiring characteristics as a high-frequency coupler by avoiding coupling of the electrode 14 and the ground 18 and for acting as an impedance matching circuit, and is short to the extent that unnecessary electric waves $E_\theta$ by the current flowing the series inductor 12 are not radiated heavily.

On the other hand, it is understood from the formula (2) that the longitudinal wave component $E_R$ is maximized when the component forms an angle $\theta=0$ with the direction of the infinitesimal dipole. Therefore, in order to conduct non-contact communication by using the longitudinal wave component $E_R$ of the electric field, high-frequency electric field signals are preferably transmitted by placing the high-frequency coupler of the communication partner in an opposed manner so that the angle $\theta$ formed with the direction of the infinitesimal dipole is about 0 degrees.

In addition, the current of the high-frequency signals flowing into the coupling electrode 14 can be greater by the resonating unit formed of the series inductor 12 and the parallel inductor 13. As a result, the moment of the infinitesimal dipole formed by the charges accumulated in the coupling electrode 14 and the mirror-image charges in the ground side can be greater, and the high-frequency electric field signals formed of the longitudinal wave $E_R$ can be efficiently radiated toward the propagating direction where the angle $\theta$ formed with the direction of the infinitesimal dipole is about 0 degrees.

In the high-frequency coupler shown in FIG. 2, the operating frequency $f_0$ is decided in an impedance matching unit by constants $L_1$ and $L_2$ of the parallel inductor and the series inductor. However, generally, since the band of a lumped constant circuit is narrower than that of a distributed constant circuit in a high-frequency circuit, and the constant of an inductor gets smaller as the frequency gets higher, it is problematic in that the resonating frequency is deviated by unevenness in the constants. With regard to this matter, it can be considered that a wider bandwidth is realized with a solution that the high-frequency coupler is constituted by replacing the lumped constant circuit with the distributed constant circuit in the impedance matching unit and the resonating unit.

Figure 7:
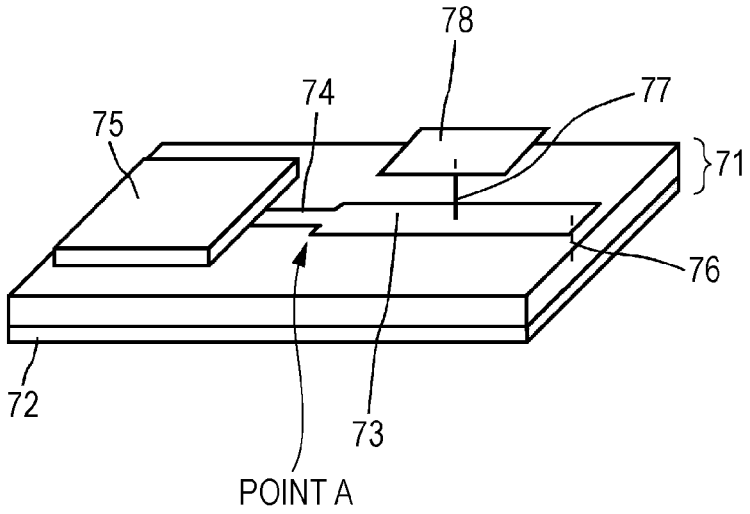
FIG. 7 is a diagram illustrating the composition example of the high-frequency coupler using a distributed constant circuit in a resonating unit.

FIG. 7 shows a composition example of a high-frequency coupler in which a distributed constant circuit is used for the impedance matching unit and the resonating unit. In the example shown in the drawing, a high-frequency coupler is provided where a ground conductor 72 is formed on the bottom surface, and a printed board 71 formed with a printed pattern is arranged on the top surface. As the impedance matching unit and the resonating unit of the high-frequency coupler, a micro-strip line or a coplanar waveguide, that is, a stub 73 is formed as a distributed constant circuit instead of a parallel inductor and a series inductor, and is connected to a transmission/reception circuit module 75 via a signal line pattern 74. The stub 73 is connected and short-circuited to the ground 72 in the bottom surface via a through-hole 76 penetrating the printed board 71 at the tip of the stub. In addition, around the center of the stub 73, a coupling electrode 78 is connected thereto via one terminal 77 formed of a thin metal line.

Furthermore, "stub" referred to in the technological field of electrical engineering is a collective term of electric wires of which one end is connected, and the other end is not connected or ground-connected, and provided in the middle of a circuit for the use of adjustment, measurement, impedance matching, filter, or the like.

Figure 8:
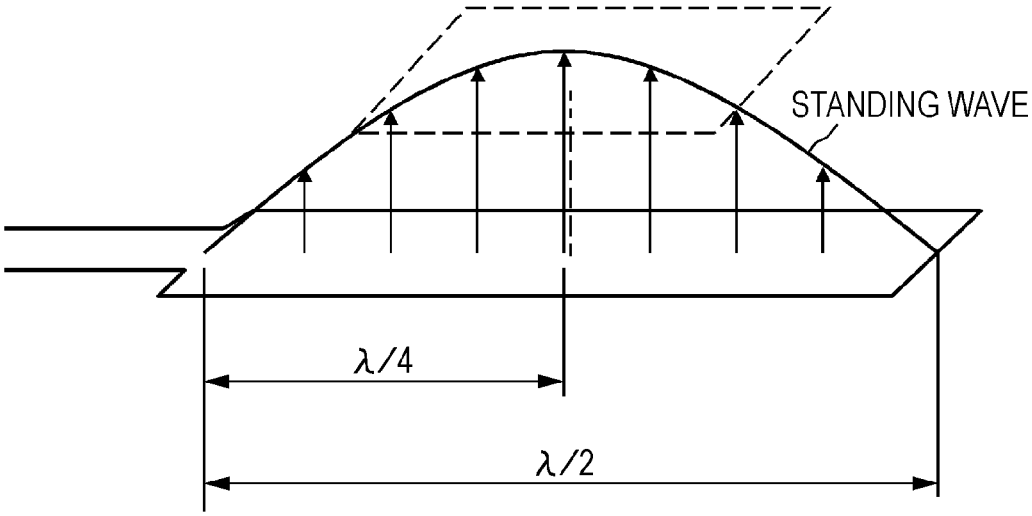
FIG. 8 is a diagram showing the state where a standing wave occurs on a stub in the high-frequency coupler shown in FIG. 7.

The signal input from the transmission/reception circuits via the signal line is reflected in the tip portion of the stub 73 and a standing wave occurs in the stub 73. The phase height of the stub 73 is about ½ of the wavelength of the high-frequency signal (180 degrees in terms of phase), the signal line 74 and the stub 73 are formed of the micro-strip line, coplanar line, and the like on the printed board 71. As shown in FIG. 8, when the tip is short-circuited with the phase height of the stub 73 of ½ of the wavelength, the voltage magnitude of the standing wave occurring in the stub 73 is 0 at the tip of the stub 73, and reaches the maximum at the center of the stub 73, that is, a point ¼ of the wavelength (90 degrees) from the tip of the stub 73. If a coupling electrode 78 is connected to one terminal 77 around the center of the stub 73 where the voltage magnitude of the standing wave reaches the maximum, a high-frequency coupler having excellent propagating efficiency can be made.

Since the stub 73 shown in FIG. 7 is the micro-strip line or the coplanar waveguide on the printed board 71, and the DC resistance is small, the high-frequency signal has little loss, and therefore, propagation loss between the high-frequency couplers can be reduced. In addition, since the size of the stub 73 constituting the distributed constant circuit is as large as ½ of the wavelength of the high-frequency signal, errors in the dimension due to tolerance during the production are very slight relative to the entire phase height, and unevenness in characteristics does not easily occur.

Subsequently, a method of expanding the communication range will be considered in the proximity wireless transfer using the weak UWB.

When the proximity wireless transferring function is applied to be incorporated into information equipment, a user is not able to see the mark of the target point attached on the housing of the equipment for the purpose of aligning, and the equipment contact deviates in the transverse direction from the center. For this reason, in order to improve the advantage of the proximity wireless transferring function in practical use, it is necessary to expand the communication range in the transverse direction.

Figure 9:
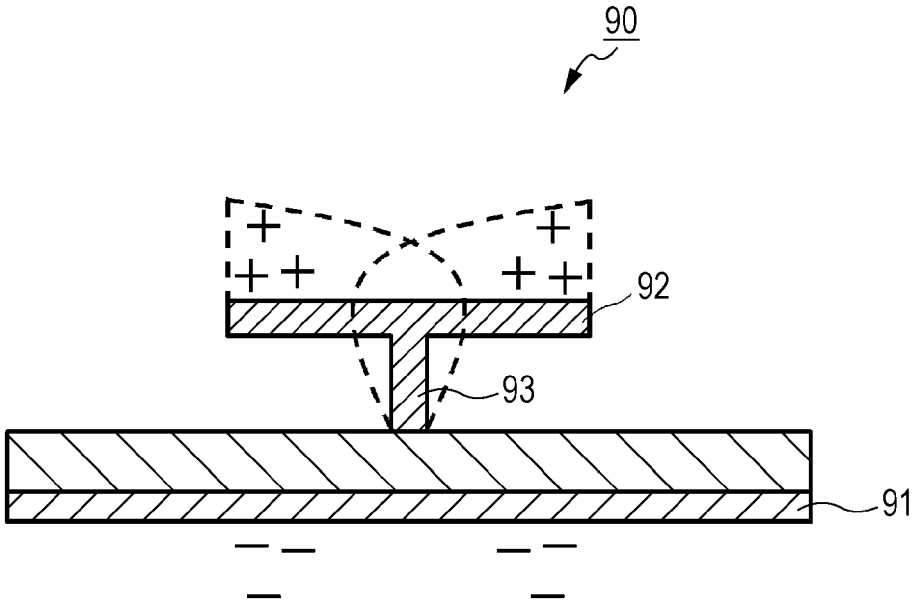
FIG. 9 is a diagram showing the state where charges are accumulated in a coupling electrode in a high-frequency coupler where the coupling electrode is mounted on a ground circuit when the coupling electrode is input with high-frequency signals.

FIG. 9 shows the state of a high-frequency coupler 90 formed by mounting a coupling electrode 92 on a ground board 91, in which charges are accumulated in the coupling electrode when a high-frequency signal is input into the coupling electrode. As shown by the drawing, the amount of the charges accumulated in the coupling electrode 92 changes in the form of a sine wave. In the high-frequency band of a GHz class of which the wavelength is as short as the UWB, the size of a coupling electrode becomes non-negligibly high relative to the wavelength. For this reason, distribution of charges such as a standing wave occurs on the coupling electrode 92. In addition, in the same drawing, the electric field occurring from the coupling electrode 92 is indicated by dotted lines.

In the example of FIG. 9, in terms of the size of the coupling electrode 92, the height from the root of a supporting unit 93 connected to the ground board 91 (resonating unit) to the tip is designed to be ¼ of the wavelength. In addition, the tip of the coupling electrode 92 is in an open-ended state. The open state corresponds to the fixed end of the standing wave of the current, and to an anti-node where the amplitude of the charges accumulated in the tip portion becomes the maximum. If high-frequency signals are input to the coupling electrode 92, the standing wave of the current occurs. In that case, the charges accumulated in each portion on the coupling electrode 92 have the same polarities at all times. In addition, the ground board 91 accumulates mirror-image charges with reverse polarity according to the charges accumulated in each portion.

Figure 10A:
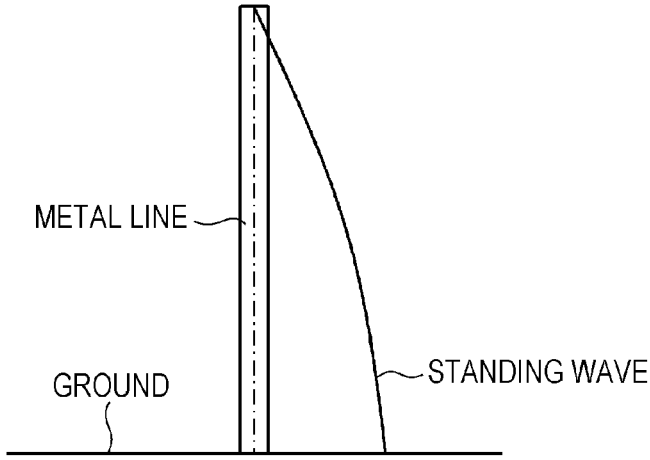
FIG. 10A is a diagram for describing ¼ of the wavelength as the size of a coupling electrode.

Herein, ¼ of the wavelength as the size of the coupling electrode will be described. As described before with reference to FIG. 6, the structure in which the coupling electrode is supported on the ground board in the high-frequency coupler is similar to that of a "capacity-loaded type" antenna which enables reduction in the height thereof. An antenna in which a metal line having the length of ¼ wavelength is erected perpendicular to the ground as shown in FIG. 10A is called a ¼ of the wavelength type monopole antenna. When a high-frequency signal is input to the metal line, the standing wave of the current occurs, the tip of the metal line serves as a fixed end of the standing wave of the current, and the current amplitude is 0. On the other hand, a power feeding point of the root of the metal line has the maximum current amplitude. Therefore, the current distribution as shown in FIG. 10A appears.

Figure 10B:
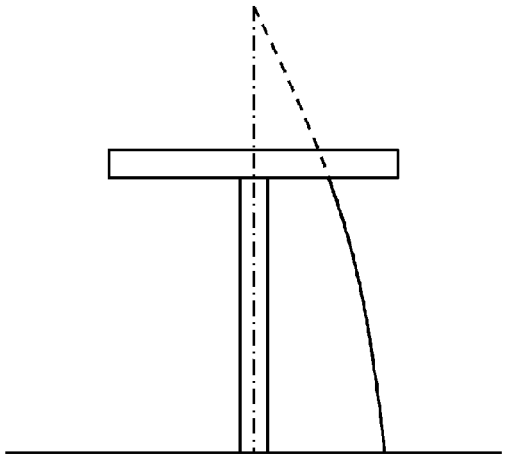
FIG. 10B is a diagram for describing ¼ of the wavelength as the size of a coupling electrode.

Incidentally, as in the related art, if the length of the metal line is shortened and the tip thereof is fixed to a metal plate, the height of the antenna can be lowered while maintaining the resonating state of ¼ of the wavelength. This is because the metal plate can accumulate charges as an electrode of one capacitor does. FIG. 10B shows the structure of a capacity-loaded type antenna of which the height is lowered. The drawing also shows the current distribution occurring in the antenna, but the current amplitude in the metal plate corresponding to the location of the tip of the shortened metal plate does not become 0, and the current distribution appears as if the metal line is lengthened to the end.

Figure 10C:
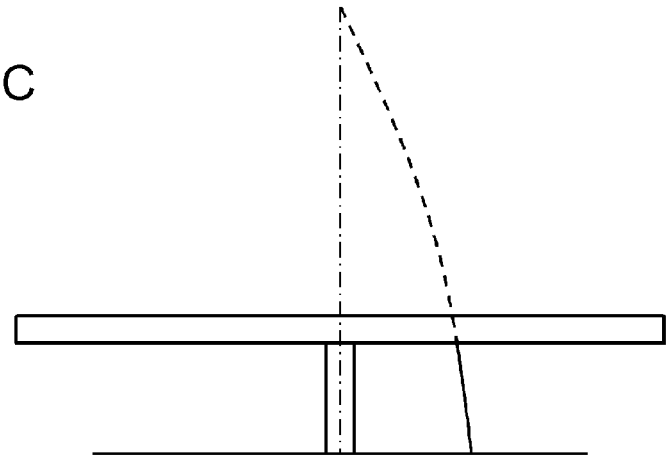
FIG. 10C is a diagram for describing ¼ of the wavelength as the size of a coupling electrode.

The capacity-loaded type antenna can be obtained by reducing the height of a monopole antenna, but what effectively operates absolutely as the radiating element of an antenna, in other words, what generates the transverse wave components $E_\theta$ of an electric field is the metal line portion. Generally, if the height of the antenna is reduced, in other words, the length of the metal line is shortened, radiation efficiency of the antenna decreases. On the other hand, in the case of a high-frequency coupler, it is desirable that the transverse wave components $E_\theta$ of an electric field, that is, the radiation of an electric wave, is small. Hence, as shown in FIG. 10C, the length of the metal line is designed to be very short relative to the wavelength, but a high-frequency coupler that radiates stronger electric field signals of the longitudinal wave component $E_R$ by setting the size of the metal plate at the tip of the metal line to the resonating state of ¼ of the wavelength together with the metal line.

Anyway, if the tip of the coupling electrode is in an open state, it is certain that the length from the root connected to the resonating unit to the tip is ¼ of the wavelength. This indicates that the communication range of the high-frequency coupler expands only up to about ¼ of the wavelength in the transverse direction.

With regard to this matter, the present inventor suggests a structure of a high-frequency coupler in which the tip portion of a coupling electrode is short-circuited to the ground.

Figure 11:
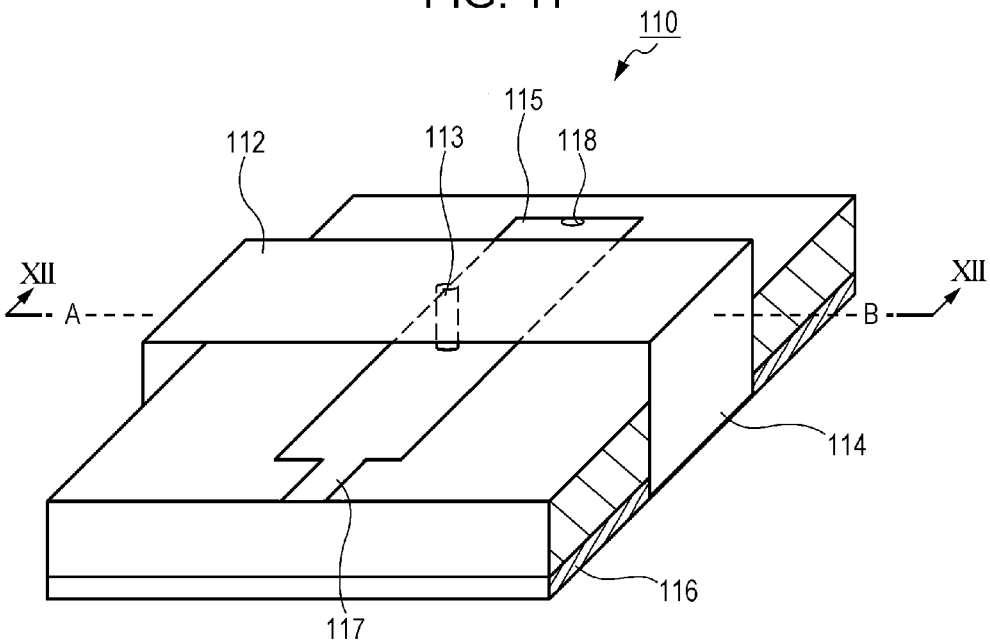
FIG. 11 is a diagram showing a composition example of a high-frequency coupler of which the tip portions of a coupling electrode are short-circuited to the ground.

FIG. 11 schematically shows the composition of a high-frequency coupler 110. In the example shown in the drawing, a resonating unit 115 is a stub with its length of ½ of the wavelength, and the tip portion thereof is short-circuited to the ground 116 via a trough-hole 118. In addition, a coupling electrode 112 is supported by a supporting unit 113 at the center of the stub. The coupling electrode 112 is supported by the supporting unit 113 about at the center on the resonating unit 115, and is in the grounded state in the short-circuiting unit 114 at the tip portions of the coupling electrode 112.

Herein, the grounded state in the short-circuiting unit 114 corresponds to a free end of the standing wave of a current, and the amplitude of charges becomes zero. In this case, the size from the root of the supporting unit 113 connected to the resonating unit 115 to the tip portion of the short-circuiting unit 114 short-circuited to the ground 116 is ½ of the wavelength, which enables to obtain the resonating state. If a high-frequency signal is input via a signal line 117 formed of a micro-strip line, the standing wave of a current occurs in the coupling electrode 112.

Figure 12:
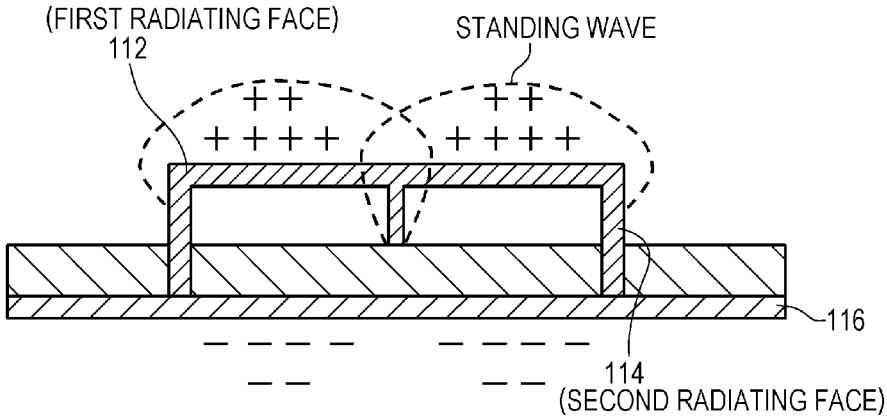
FIG. 12 is a cross-sectional view of the high-frequency coupler shown in FIG. 11.

FIG. 12 shows a cross-sectional view of the high-frequency coupler 110 shown in FIG. 11 by the line XII-XII, and the distribution of accumulated charges. In addition, in the drawing, the electric field occurring from the coupling electrode 112 is shown by dotted lines. If a high-frequency signal is input via a signal line formed of a micro-strip line, the standing wave of the current occurs. Since the amplitude of the charges becomes zero at the anti-node where the current amplitude becomes the maximum, the amplitude of the charges becomes zero at the root of the supporting unit 113 and the short-circuiting unit 114 of the tip portions of the coupling electrode 112, and a resonating state of ½ of the wavelength can be obtained as shown in the drawing. In comparison to the high-frequency coupler 90 shown in FIG. 9, the size of the coupling electrode 112 is doubled, and the distribution of the charges expands in the transverse direction. This indicates that the communication range of the coupling electrode 112 in the high-frequency coupler 110 is widened to be double in the transverse direction.

Figure 17:
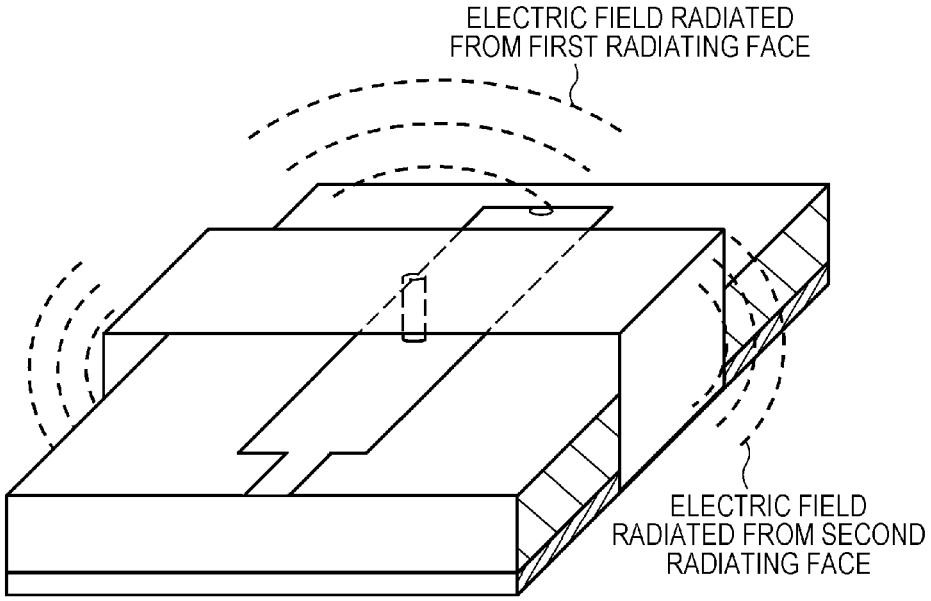
FIG. 17 is a diagram showing the state where electric fields are radiated each from a first radiating face and a second radiating face of the coupling electrode of the high-frequency coupler shown in FIG. 11.

In the composition example shown in FIG. 11, both ends of the metal plate that forms the coupling electrode 112 are subject to a bending process to form the short-circuiting unit 114. If the resonating state of ½ of the wavelength is obtained in the coupling electrode 112, only charges with the same polarity are distributed not only to the front of the coupling electrode 112 but also to the short-circuiting unit 114 to the side. In such a case, the front direction of the coupling electrode 112 is a radiation direction of electric field signals in which the face can serve as a first radiating face, and on the other hand, the side direction of the short-circuiting unit 114 is a radiation direction of electric field signals in which the face can serve as a second radiating face. With the increased size of the coupling electrode and the action of the second radiating face, the communication range of the coupling electrode 112 can be expected to expand further in the transverse direction. FIG. 17 shows the state where electric fields are radiated each from the first radiating face and the second radiating face of the coupling electrode 112.

In the case where the high-frequency coupler 110 is installed in a wireless communication terminal, if the first radiating face of the coupling electrode 112 is arranged inside the front of the housing of the terminal, and the second radiating face of the coupling electrode 112 is in the side of the housing, electric field signals can be radiated from a plurality of directions of the front and the side direction of the wireless communication terminal.

Figure 18:
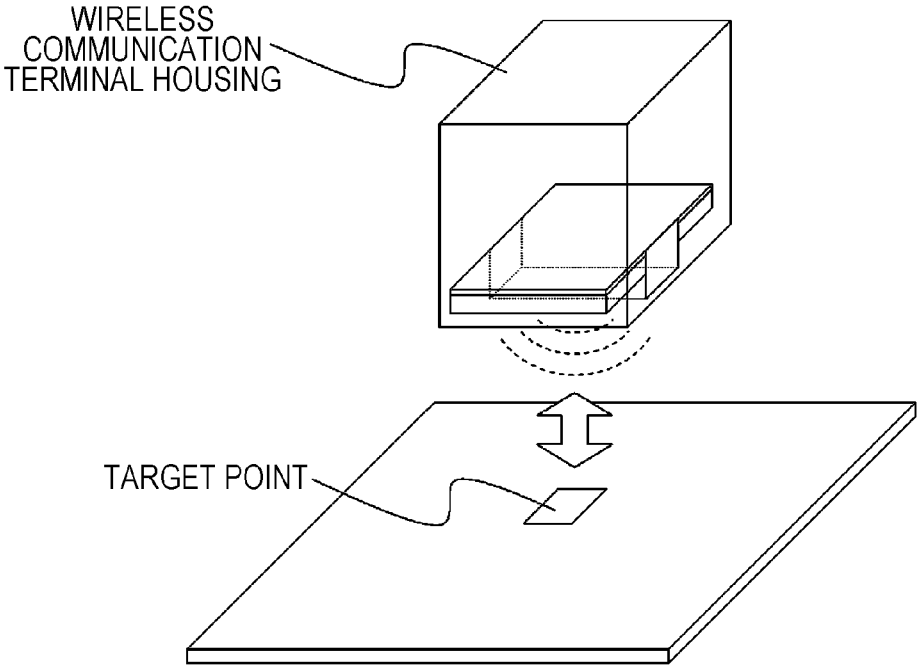
FIG. 18 is a diagram showing the state where a wireless communication terminal mounted with the high-frequency coupler shown in FIG. 11 approaches a target point in the front direction.
Figure 19:
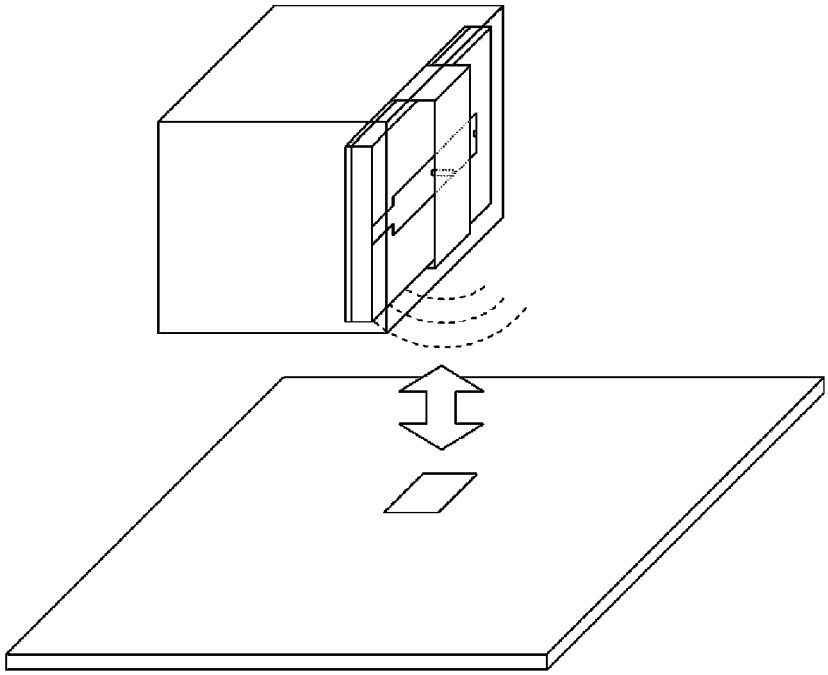
FIG. 19 is a diagram showing the state where a wireless communication terminal mounted with the high-frequency coupler shown in FIG. 11 approaches a target point in the side direction.

In such a case, communication is possible not only when the target point is contacted to the front direction of the wireless communication terminal as shown in FIG. 18 but also when the target point is contacted to the side direction thereof as shown in FIG. 19. Thus, the degree of freedom in designing the housing of the wireless communication terminal can be increased, and convenience for users in using a proximity wireless transfer system can be improved.

A wireless communication terminal that enables communication in two directions of the front and the side can be realized by one high-frequency coupler 110. For example, when communication is to be performed between high-frequency couplers, which are used for producing small-sized wireless communication terminals built in notebooks, communication is possible such that the wireless communication terminals are put over target points arranged on the palm rests of notebooks or the like. In addition, if the wireless communication terminal is so big that it is not able to be put over the target point, communication can be performed by placing the terminal transversely.

Figure 13:
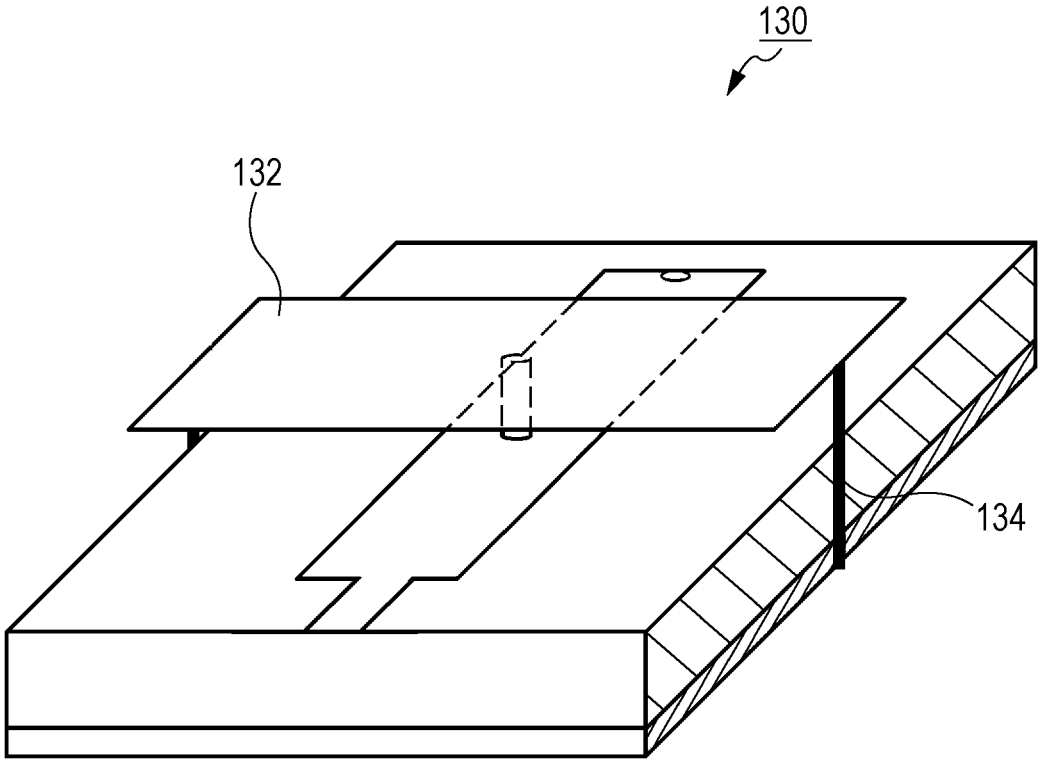
FIG. 13 is a diagram showing a modified example of a high-frequency coupler.

Furthermore, the gist of the present invention is not limited to the configuration where the coupling electrode 112 and the short-circuiting unit 114 are formed by subjecting the metal plate to the bending process, as shown in FIG. 11. For example, as shown in FIG. 13, the tip portions of the coupling electrode 132 may be short-circuited by the short-circuiting unit 134 made of a wire.

Figure 14:
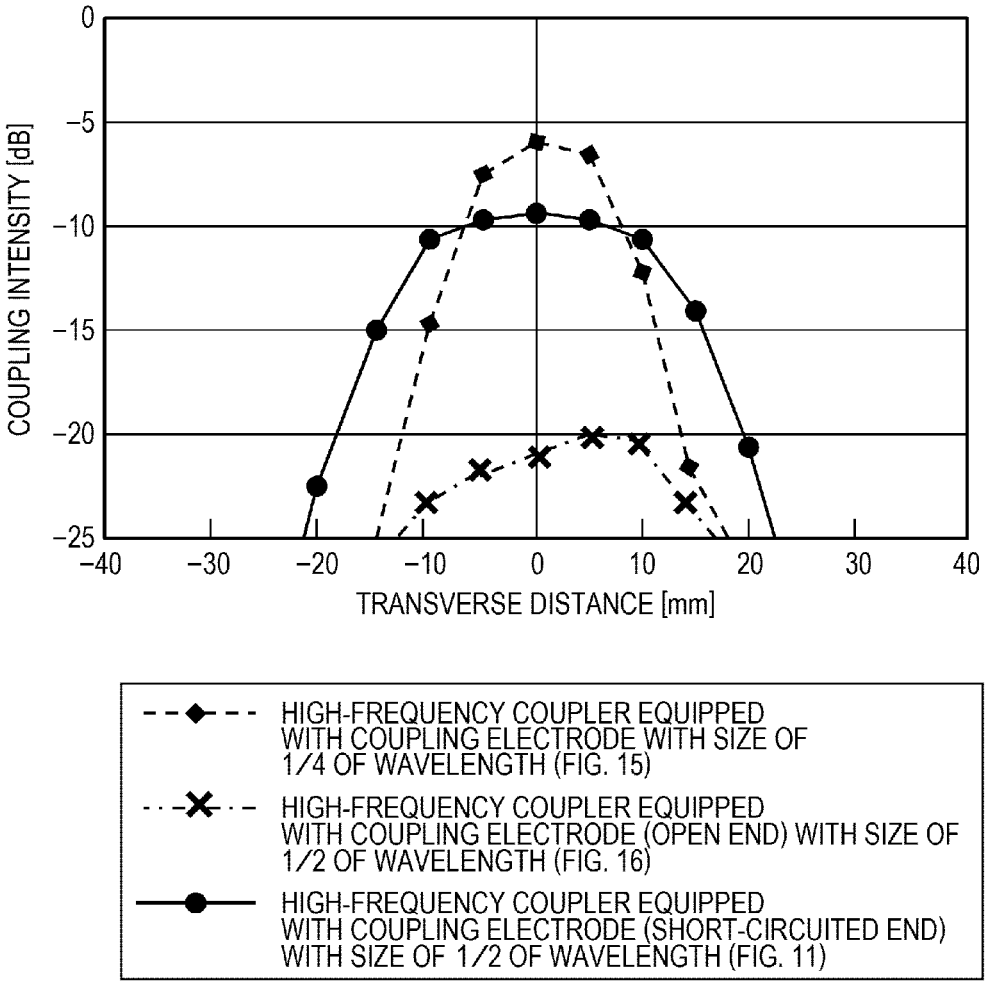
FIG. 14 is a diagram showing a result obtained by measuring coupling intensities when the high-frequency couplers shown in FIG. 11 face each other in the front direction.

FIG. 14 shows the results obtained by measuring coupling intensities when the high-frequency couplers shown in FIG. 11 face in the front direction. However, the coupling intensities were measured while both of the coupling electrodes 112 are moved in the transverse direction in the face perpendicular to the first radiating face that includes the line XII-XII in FIG. 11.

Figure 15:
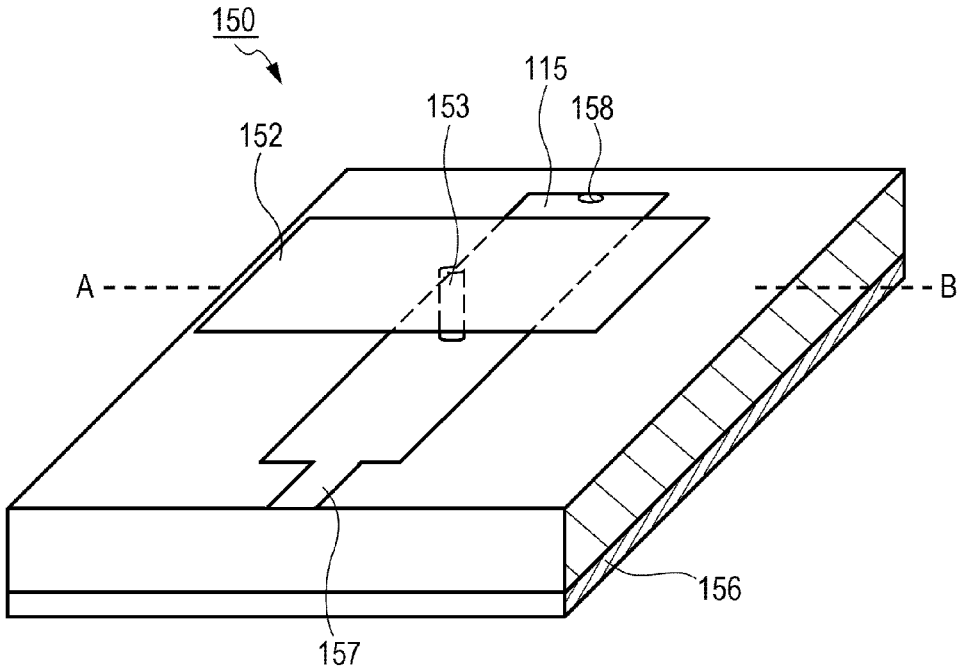
FIG. 15 is a diagram showing a high-frequency coupler provided with a coupling electrode having the size of ¼ of the wavelength on a resonating unit formed of the same stub as the high-frequency coupler shown in FIG. 11.
Figure 16:
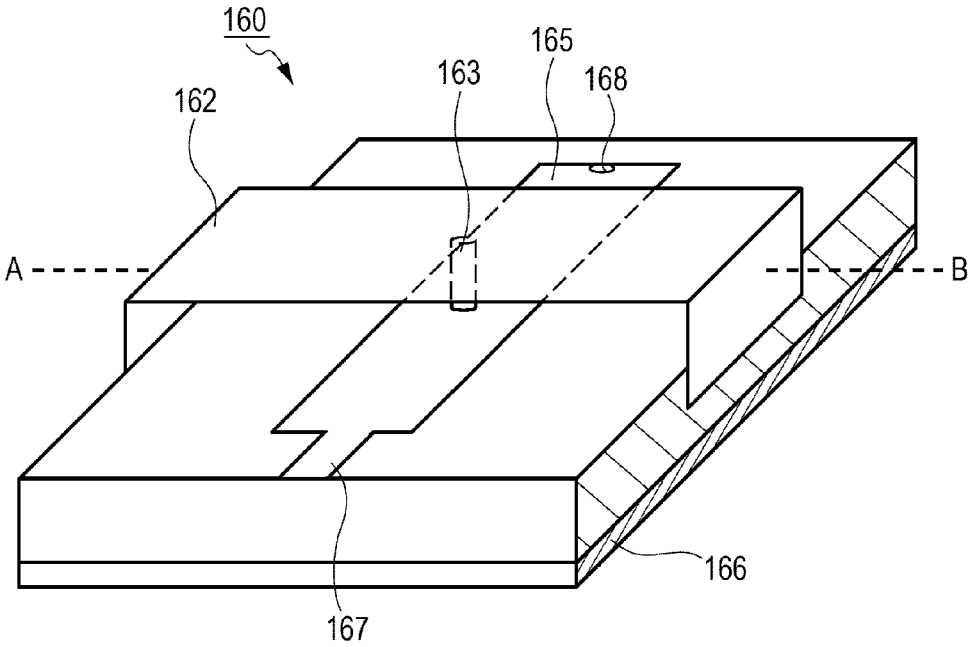
FIG. 16 is a diagram showing a high-frequency coupler provided with a coupling electrode that has the size of about ½ of the wavelength but of which a tip portion is not short-circuited on a resonating unit formed of the same stub as the high-frequency coupler shown in FIG. 11.

In addition, as a comparison, the results are shown in FIG. 14 which are obtained by measuring the coupling intensities in the same manner for a high-frequency coupler 150 provided with a coupling electrode 152 having the size of ¼ of the wavelength on a resonating unit 155 formed of the same stub as that of the high-frequency coupler 110 shown in FIG. 11 (refer to FIG. 15), and a high-frequency coupler 160 provided with a coupling electrode 162, which has the size of about ½ of the wavelength but is not short-circuited by a short-circuiting unit, on a resonating unit 165 formed of the same stub as that of the high-frequency coupler 110 shown in FIG. 11 (refer to FIG. 16).

When the measurement results of the high-frequency coupler 110 shown in FIG. 11 and the high-frequency coupler 150 shown in FIG. 15 are compared to each other, since the charges in the coupling electrode 112 that have twice the size of the counterpart in FIG. 15 are dispersed in the high-frequency coupler 110, the coupling intensity in the right front face (distance in the transverse direction=0 mm), that is, in the peak location is weak, but reduction of the coupling intensity when the distance of the transverse direction is increased is lessened. Therefore, it can be understood that the communication distance is widened according to the deviation in the transverse direction.

In addition, when the measurement results of the high-frequency coupler 110 shown in FIG. 11 and the high-frequency coupler 160 shown in FIG. 16 are compared to each other, the coupling electrode of the latter is remarkably low. This is because a resonating state of ½ of the wavelength is not able to be obtained as the tip portions of the coupling electrode 162 are not short-circuited to the ground, and charges with different polarities are distributed inside the surface of the coupling electrode 162, thereby cancelling the electric fields of the charges with both polarities.

When it comes to comparing the measurement results of the high-frequency coupler 110 shown in FIG. 11 and the high-frequency coupler 160 shown in FIG. 16, the reason that the communication range of the high-frequency coupler 110 is expanded in the transverse direction is understood not because the size of the coupling electrode 112 is doubled simply, but because the tip portions are short-circuited to the ground to obtain the resonating state of ½ of the wavelength and then only the charges with the same polarities are distributed in the radiating direction of the electric field signal.

The present application contains subject matter related to that disclosed in Japanese Priority Patent Application JP 2010-056561 filed in the Japan Patent Office on Mar. 12, 2010, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A high-frequency coupler comprising:

a ground;

a coupling electrode which faces the ground and is supported so as to be separated by a negligible height with respect to a wavelength of a high-frequency signal;

a resonating unit to increase a current flowing into the coupling electrode via a transmission path;

a supporting unit which is connected to the resonating unit at about a center of the coupling electrode; and a short-circuiting unit to short-circuit tip portions of the coupling electrode to the ground, wherein an infinitesimal dipole constituted by a line connecting a center of charges accumulated in the coupling electrode and a center of mirror-image charges accumulated in the ground is formed, and the high-frequency signal is transmitted toward a high-frequency coupler of a communication partner side arranged to face each other so that an angle θ formed in a direction of the infinitesimal dipole is substantially 0 degrees.

2. The high-frequency coupler according to claim 1, wherein the coupling electrode has a size of ½ of the wavelength from a root of the supporting unit to tip portions which are short-circuited to the ground via the short-circuiting unit.

3. The high-frequency coupler according to claim 1, wherein a front direction of the coupling electrode is a radiation direction of electric field signals in which a face can serve as a first radiating face, and a side direction of the short-circuiting unit is a radiation direction of electric field signals in which the face can serve as a second radiating face.

4. A communication device comprising:

a communication circuit unit to perform a process of transmitting data using a high-frequency signal;

a transmission path of a high-frequency signal connected to the communication circuit unit;

a ground;

a coupling electrode which faces the ground and is supported so as to be separated by a negligible height with respect to a wavelength of the high-frequency signal;

a resonating unit to increase a current flowing into the coupling electrode via the transmission path;

a supporting unit which is connected to the resonating unit at about a center of the coupling electrode; and a short-circuiting unit to short-circuit tip portions of the coupling electrode to the ground, wherein the coupling electrode has a size of ½ of the wavelength from a root of the supporting unit to tip portions which are short-circuited to the ground via the short-circuiting unit, and wherein an infinitesimal dipole constituted by a line connecting a center of charges accumulated in the coupling electrode and a center of mirror-image charges accumulated in the ground is formed, and the high-frequency signal is transmitted toward a high-frequency coupler of a communication partner side arranged to face each other so that an angle θ formed in a direction of the infinitesimal dipole is substantially 0 degrees.

* * * * *